US010937366B2

(12) United States Patent
Kim et al.

(10) Patent No.: US 10,937,366 B2
(45) Date of Patent: Mar. 2, 2021

(54) PIXEL CIRCUIT OF DISPLAY APPARATUS

(71) Applicant: Samsung Display Co., Ltd., Yongin-si (KR)

(72) Inventors: Jiwoong Kim, Suwon-si (KR); Ohjo Kwon, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/578,848

(22) Filed: Sep. 23, 2019

(65) Prior Publication Data

US 2020/0160780 A1 May 21, 2020

(30) Foreign Application Priority Data

Nov. 21, 2018 (KR) ..... 10-2018-0144326

(51) Int. Cl.
*G09G 3/325* (2016.01)
*G09G 3/3291* (2016.01)

(52) U.S. Cl.
CPC ..... *G09G 3/325* (2013.01); *G09G 3/3291* (2013.01); *G09G 2310/0264* (2013.01)

(58) Field of Classification Search
CPC .... G09G 3/3233; G09G 3/325; G09G 3/3266; G09G 3/3291; G09G 2300/0819; G09G 2300/0842; G09G 2300/0861; G09G 2310/0251; G09G 2310/0264;
(Continued)

(56) References Cited

U.S. PATENT DOCUMENTS 9,733,761 B2 8/2017 Ku et al.
9,892,688 B2 2/2018 In et al.
10,109,239 B2 10/2018 In
(Continued)

FOREIGN PATENT DOCUMENTS

EP 3327710 5/2018
KR 10-2014-0077458 6/2014
(Continued)

OTHER PUBLICATIONS

Extended European Search Report dated Mar. 20, 2020 in European Patent Application No. 19210526.0.

*Primary Examiner* — Nelson M Rosario
(74) *Attorney, Agent, or Firm* — H.C. Park & Associates, PLC

(57) ABSTRACT

A pixel circuit includes first to fifth transistors, an organic light emitting element, and a capacitor. The second transistor includes a control electrode receiving a first scan signal, an input electrode receiving a data voltage, and an output electrode connected to the control electrode of the first transistor. The third transistor includes a control electrode receiving a second scan signal, an input electrode receiving an initialization voltage, and an output electrode connected to the output electrode of the first transistor. The fourth transistor includes a control electrode receiving an emission signal, an input electrode receiving a first power voltage, and an output electrode connected to the input electrode of the first transistor. The fifth transistor includes a control electrode receiving a third scan signal, an input electrode receiving the data voltage, and an output electrode connected to the input electrode of the first transistor.

18 Claims, 9 Drawing Sheets

(58) Field of Classification Search
CPC ... G09G 2320/0233; G09G 2320/0295; G09G 2320/043
See application file for complete search history.

(56) References Cited

U.S. PATENT DOCUMENTS

| | | | | |
|---|---|---|---|---|
| 10,147,354 | B2 | 12/2018 | Kim et al. | |
| 10,424,246 | B2 | 9/2019 | Yuan | |
| 2004/0108518 | A1 | 6/2004 | Jo | |
| 2017/0025063 | A1* | 1/2017 | Chaji | G09G 3/3233 |
| 2019/0027091 | A9* | 1/2019 | Yuan | G09G 3/32 |

FOREIGN PATENT DOCUMENTS

| | | |
|---|---|---|
| KR | 10-2016-0084941 | 7/2016 |
| KR | 10-2016-0085978 | 7/2016 |
| KR | 10-2017-0066733 | 6/2017 |
| KR | 10-2018-0014387 | 2/2018 |

* cited by examiner

PIXEL CIRCUIT OF DISPLAY APPARATUS

CROSS-REFERENCE TO RELATED APPLICATION

This application claims priority from and the benefit of Korean Patent Application No. 10-2018-0144326, filed on Nov. 21, 2018, which is hereby incorporated by reference for all purposes as if fully set forth herein.

BACKGROUND

Field

Exemplary embodiments of the inventive concepts relate to a pixel circuit of a display apparatus, and more particularly, to a pixel circuit of a display apparatus sensing a threshold voltage of a driving switching element to enhance a display quality of a display panel.

Discussion of the Background

A display apparatus includes a display panel and a display panel driver. The display panel includes a plurality of gate lines, a plurality of data lines, a plurality of emission lines and a plurality of pixels. The display panel driver includes a gate driver, a data driver, an emission driver and a driving controller. The gate driver outputs gate signals to the gate lines. The data driver outputs data voltages to the data lines. The emission driver outputs emission signals to the emission lines. The driving controller controls the gate driver, the data driver and the emission driver.

Threshold voltages of driving switching elements in pixel circuits which vary due to process variance are required to be compensated to maintain a luminance uniformity of the display panel.

When the threshold voltages of driving switching elements in pixel circuits are not compensated, the luminance uniformity of the display panel may be reduced so that the display quality of the display panel may be deteriorated.

When elements to compensate the threshold voltages of driving switching elements are included in the pixel circuit, the number of the switching elements in the pixel circuit may increase and the manufacturing cost of the display panel may increase.

The above information disclosed in this Background section is only for understanding of the background of the inventive concepts, and, therefore, it may contain information that does not constitute prior art.

SUMMARY

Exemplary embodiments of the inventive concepts provide a pixel circuit of a display apparatus capable of sensing a threshold voltage of a driving switching element to enhance a display quality of a display panel.

Additional features of the inventive concepts will be set forth in the description which follows, and in part will be apparent from the description, or may be learned by practice of the inventive concepts.

In an exemplary embodiment of a pixel circuit of a display apparatus according to the inventive concepts, the pixel circuit includes a first switching element, a second switching element, a third switching element, a fourth switching element, a fifth switching element, an organic light emitting element and a capacitor. The first switching element includes a control electrode, an input electrode and an output electrode. The second switching element includes a control electrode to which a first scan signal is applied, an input electrode to which a data voltage is applied, and an output electrode connected to the control electrode of the first switching element. The third switching element includes a control electrode to which a second scan signal is applied, an input electrode to which an initialization voltage is applied, and an output electrode connected to the output electrode of the first switching element. The fourth switching element includes a control electrode to which an emission signal is applied, an input electrode to which a first power voltage is applied, and an output electrode connected to the input electrode of the first switching element. The fifth switching element includes a control electrode to which a third scan signal is applied, an input electrode to which the data voltage is applied, and an output electrode connected to the input electrode of the first switching element. The organic light emitting element includes a first electrode connected to the output electrode of the first switching element and a second electrode to which a second power voltage is applied. The capacitor includes a first end connected to the control electrode of the first switching element and a second end connected to the output electrode of the first switching element.

In an exemplary embodiment, the first scan signal and the second scan signal may have an activation level and the third scan signal may have a deactivation level during a first duration of a threshold voltage sensing mode. The first scan signal may have the deactivation level and the second scan signal and the third scan signal may have the activation level during a second duration of the threshold voltage sensing mode.

In an exemplary embodiment, a threshold voltage of the first switching element may be sensed using the third switching element and an initialization voltage applying line which applies the initialization voltage during the second duration of the threshold voltage sensing mode.

In an exemplary embodiment, the first scan signal and the second scan signal may have the activation level and the third scan signal may have the deactivation level during a first duration of a display mode. The first scan signal, the second scan signal and the third scan signal may have the deactivation level and the emission signal may have the activation level during a second duration of the display mode.

In an exemplary embodiment, the pixel circuit may further include a first switch connecting the input electrode of the second switching element and a data line and a second switch connecting the input electrode of the second switching element and a sensing line.

In an exemplary embodiment, the first scan signal, the second scan signal and the third scan signal, a control signal of the first switch may have an activation level and a control signal of the second switch may have a deactivation level during a first duration of a threshold voltage sensing mode. The first scan signal, the second scan signal, the third scan signal and the control signal of the second switch may have the activation level and the control signal of the first switch may have the deactivation level during a second duration of the threshold voltage sensing mode.

In an exemplary embodiment, a length of the second duration of the threshold voltage sensing mode may be longer than a length of the first duration of the threshold voltage sensing mode.

In an exemplary embodiment, a threshold voltage of the first switching element may be sensed based on a voltage of the input electrode of the second switching element using the second switch and the sensing line during the second duration of the threshold voltage sensing mode.

In an exemplary embodiment, the first scan signal, the second scan signal and the control signal of the first switch may have the activation level and the third scan signal and the control signal of the second switch may have the deactivation level during a first duration of a display mode. The first scan signal, the second scan signal, the third scan signal and the control signal of the second switch may have the deactivation level and the emission signal may have the activation level during a second duration of the display mode.

In an exemplary embodiment, the first to fifth switching elements may be N-type transistors.

In an exemplary embodiment of a pixel circuit of a display apparatus according to the inventive concepts, the pixel circuit includes a first switching element, a second switching element, a third switching element, a fourth switching element, a fifth switching element, an organic light emitting element and a capacitor. The first switching element includes a control electrode, an input electrode and an output electrode. The second switching element includes a control electrode to which a first scan signal is applied, an input electrode to which a data voltage is applied, and an output electrode connected to the control electrode of the first switching element. The third switching element includes a control electrode to which a second scan signal is applied, an input electrode to which an initialization voltage is applied, and an output electrode connected to the output electrode of the first switching element. The fourth switching element includes a control electrode to which an emission signal is applied, an input electrode to which a first power voltage is applied, and an output electrode connected to the input electrode of the first switching element. The fifth switching element includes a control electrode to which a third scan signal is applied, an input electrode connected to the input electrode of the first switching element and an output electrode connected to the control electrode of the first switching element. The organic light emitting element includes a first electrode connected to the output electrode of the first switching element and a second electrode to which a second power voltage is applied. The capacitor includes a first end connected to the control electrode of the first switching element and a second end connected to the output electrode of the first switching element.

In an exemplary embodiment, the pixel circuit may further include a first switch connecting the input electrode of the second switching element and a data line and a second switch connecting the input electrode of the second switching element and a sensing line.

In an exemplary embodiment, the first scan signal, the second scan signal and the third scan signal, a control signal of the first switch may have an activation level and a control signal of the second switch may have a deactivation level during a first duration of a threshold voltage sensing mode. The first scan signal, the second scan signal, the third scan signal and the control signal of the second switch may have the activation level and the control signal of the first switch may have the deactivation level during a second duration of the threshold voltage sensing mode.

In an exemplary embodiment, a length of the second duration of the threshold voltage sensing mode may be longer than a length of the first duration of the threshold voltage sensing mode.

In an exemplary embodiment, the first scan signal, the second scan signal and the control signal of the first switch may have the activation level and the third scan signal, the control signal of the second switch and the emission signal may have the deactivation level during a first duration of a display mode. The first scan signal, the second scan signal, the third scan signal and the control signal of the second switch may have the deactivation level and the emission signal may have the activation level during a second duration of the display mode.

In an exemplary embodiment of a pixel circuit of a display apparatus according to the inventive concepts, the pixel circuit includes a first switching element, a second switching element, a third switching element, a fourth switching element, an organic light emitting element and a capacitor. The first switching element includes a control electrode, an input electrode and an output electrode. The second switching element includes a control electrode to which a first scan signal is applied, an input electrode to which a data voltage is applied, and an output electrode connected to the control electrode of the first switching element. The third switching element includes a control electrode to which an emission signal is applied, an input electrode connected to the output electrode of the first switching element and an output electrode connected to a first electrode of an organic light emitting element. The fourth switching element includes a control electrode to which a second scan signal is applied, an input electrode to which the data voltage is applied, and an output electrode connected to the output electrode of the first switching element. The organic light emitting element includes the first electrode connected to the output electrode of the third switching element and a second electrode to which a low power voltage is applied. The capacitor includes a first end connected to the input electrode of the first switching element and a second end connected to the control electrode of the first switching element.

In an exemplary embodiment, the pixel circuit may further include a first switch connecting the input electrode of the second switching element and a data line and a second switch connecting the input electrode of the second switching element and a sensing line.

In an exemplary embodiment, the pixel circuit may further include a third switch configured to apply a high power voltage to the input electrode of the first switching element and a fourth switch configured to apply a reference voltage to the input electrode of the first switching element.

In an exemplary embodiment, the first scan signal, the second scan signal, a control signal of the first switch and a control signal of the fourth switch may have an activation level and a control signal of the second switch and a control signal of the third switch may have a deactivation level during a first duration of a threshold voltage sensing mode. The first scan signal, the second scan signal, the control signal of the second switch and the control signal of the fourth switch may have the activation level and the control signal of the first switch and the control signal of the third switch may have the deactivation level during a second duration of the threshold voltage sensing mode.

In an exemplary embodiment, the first to fourth switching elements may be P-type transistors.

According to the pixel circuit of the display apparatus, the threshold voltage of the driving switching element in the pixel circuit may be sensed and the threshold voltage of the driving switching element may be compensated. Thus, the luminance uniformity of the display panel may be enhanced so that the display quality may be enhanced.

In addition, the elements compensating the threshold voltage may not be included in the pixel circuit. The elements compensating the threshold voltage may sense the threshold voltage at an outside of the pixel circuit so that the number of the switching elements in the pixel circuit may be reduced. Thus, the manufacturing cost of the display panel may be reduced.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION

Figure 1:
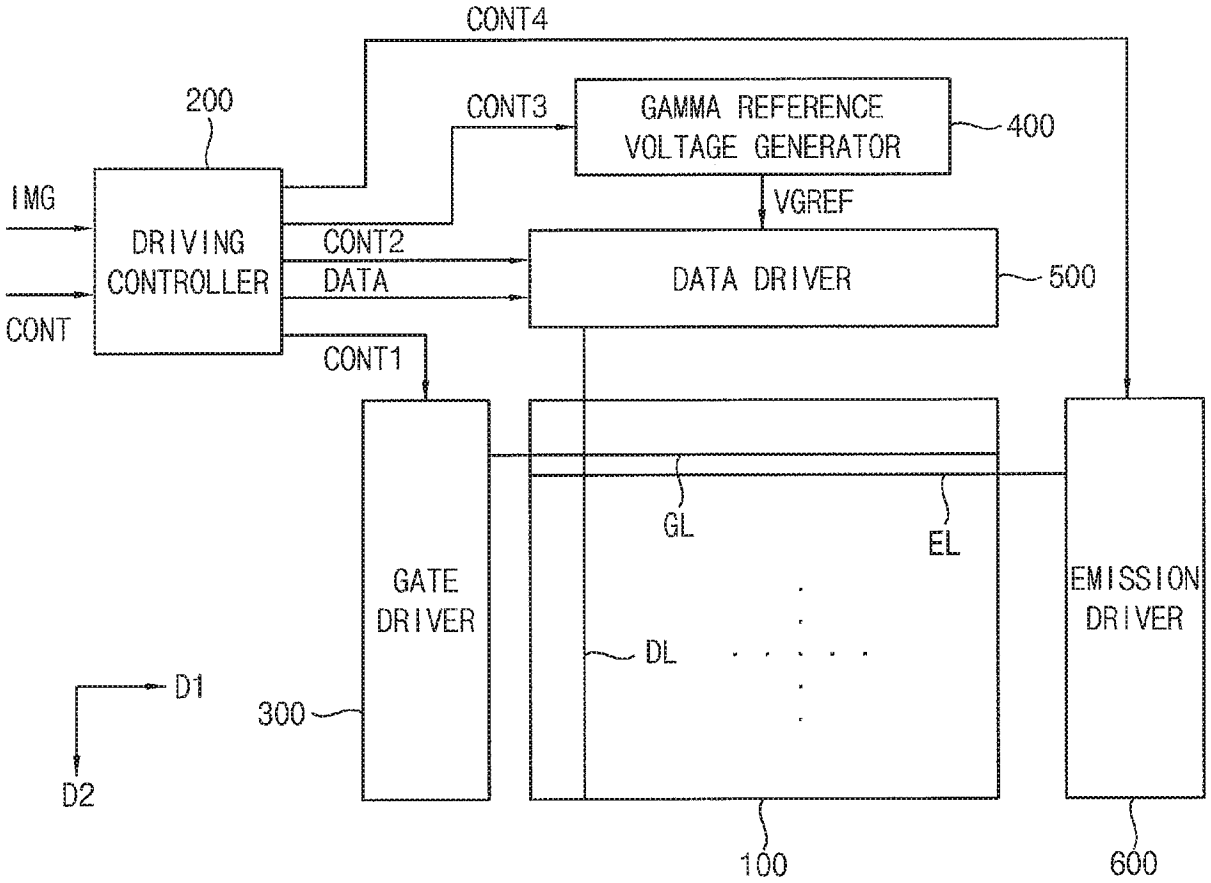
FIG. 1 is a block diagram illustrating a display apparatus according to an exemplary embodiment of the inventive concepts.

In the following description, for the purposes of explanation, numerous specific details are set forth in order to provide a thorough understanding of various exemplary embodiments or implementations of the invention. As used herein "embodiments" and "implementations" are interchangeable words that are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath"

other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the scope of the inventive concepts. Further, the blocks, units, and/or modules of some exemplary embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

Hereinafter, the inventive concepts will be explained in detail with reference to the accompanying drawings.

FIG. 1 is a block diagram illustrating a display apparatus according to an exemplary embodiment of the inventive concepts.

Referring to FIG. 1, the display apparatus includes a display panel 100 and a display panel driver. The display panel driver includes a driving controller 200, a gate driver 300, a gamma reference voltage generator 400, a data driver 500, and an emission driver 600.

The display panel 100 has a display region on which an image is displayed and a peripheral region adjacent to the display region.

The display panel 100 includes a plurality of gate lines GL, a plurality of data lines DL, a plurality of emission lines EL, and a plurality of pixels electrically connected to the gate lines GL, the data lines DL and the emission lines EL. The gate lines GL may extend in a first direction D1, the data lines DL may extend in a second direction D2 crossing the first direction D1, and the emission lines EL may extend in the first direction D1.

The driving controller 200 receives input image data IMG and an input control signal CONT from an external apparatus (not shown). For example, the input image data IMG may include red image data, green image data, and blue image data. The input image data IMG may include white image data. The input image data IMG may include magenta image data, cyan image data, and yellow image data. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3, a fourth control signal CONT4, and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

The driving controller 200 generates the third control signal CONT3 for controlling an operation of the gamma reference voltage generator 400 based on the input control signal CONT, and outputs the third control signal CONT3 to the gamma reference voltage generator 400.

The driving controller 200 generates the fourth control signal CONT4 for controlling an operation of the emission driver 600 based on the input control signal CONT, and outputs the fourth control signal CONT4 to the emission driver 600.

The gate driver 300 generates gate signals driving the gate lines GL in response to the first control signal CONT1 received from the driving controller 200. The gate driver 300 may sequentially output the gate signals to the gate lines GL.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500.

The gamma reference voltage VGREF has a value corresponding to a level of the data signal DATA.

In an exemplary embodiment, the gamma reference voltage generator 400 may be disposed in the driving controller 200, or in the data driver 500.

The data driver 500 receives the second control signal CONT2 and the data signal DATA from the driving controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

For example, the data driver 500 may be integrally formed with the driving controller 200 to form a timing controller embedded data driver TED.

The emission driver 600 generates emission signals to drive the emission lines EL in response to the fourth control signal CONT4 received from the driving controller 200. The emission driver 600 may output the emission signals to the emission lines EL.

Figure 2:
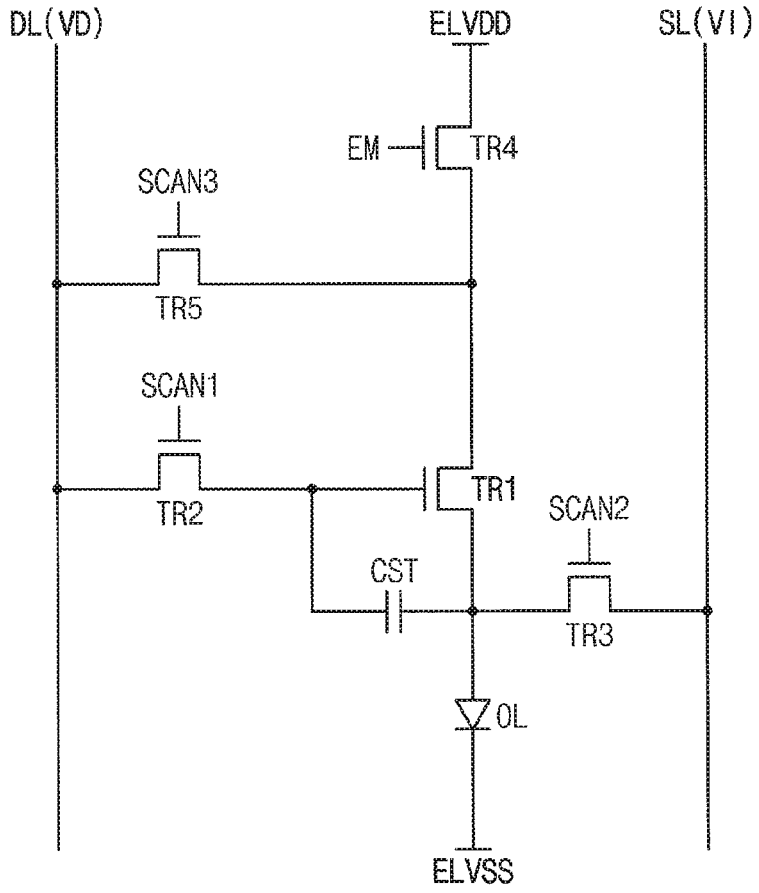
FIG. 2 is a circuit diagram illustrating a pixel circuit of a display panel of FIG. 1.

FIG. 2 is a circuit diagram illustrating a pixel circuit of the display panel 100 of FIG. 1.

Referring to FIGS. 1 and 2, the display panel 100 includes a plurality of pixel circuits.

In the present exemplary embodiment, the pixel circuit includes a first switching element TR1, a second switching element TR2, a third switching element TR3, a fourth switching element TR4, a fifth switching element TR5, an organic light emitting element OL, and a capacitor CST.

The first switching element TR1 includes a control electrode, an input electrode, and an output electrode.

The second switching element TR2 includes a control electrode to which a first scan signal SCAN1 is applied, an input electrode to which a data voltage VD is applied, and an output electrode connected to the control electrode of the first switching element TR1.

The third switching element TR3 includes a control electrode to which a second scan signal SCAN2 is applied, an input electrode to which an initialization voltage VI is applied, and an output electrode connected to the output electrode of the first switching element TR1.

The fourth switching element TR4 includes a control electrode to which an emission signal EM is applied, an input electrode to which a first power voltage ELVDD is applied, and an output electrode connected to the input electrode of the first switching element TR1.

The fifth switching element TR5 includes a control electrode to which a third scan signal SCAN3 is applied, an input electrode to which the data voltage VD is applied, and an output electrode connected to the input electrode of the first switching element TR1.

The organic light emitting element OL includes a first electrode connected to the output electrode of the first switching element TR1 and a second electrode to which a second power voltage ELVSS is applied.

The capacitor CST includes a first end connected to the control electrode of the first switching element TR1 and a second end connected to the output electrode of the first switching element TR1.

In the present exemplary embodiment, the first to fifth switching elements TR1 to TR5 may be N-type transistors. For example, the first to fifth switching elements TR1 to TR5 may be oxide thin film transistors.

The first to third scan signals SCAN1 to SCAN3 may be gate signals generated by the gate driver 300. The first to third scan signals SCAN1 to SCAN3 may be outputted from the gate driver 300 to the pixel circuit through the gate line GL. The pixel circuit may be connected to three gate lines applying the first to third scan signals SCAN1 to SCAN3.

Figure 3A:
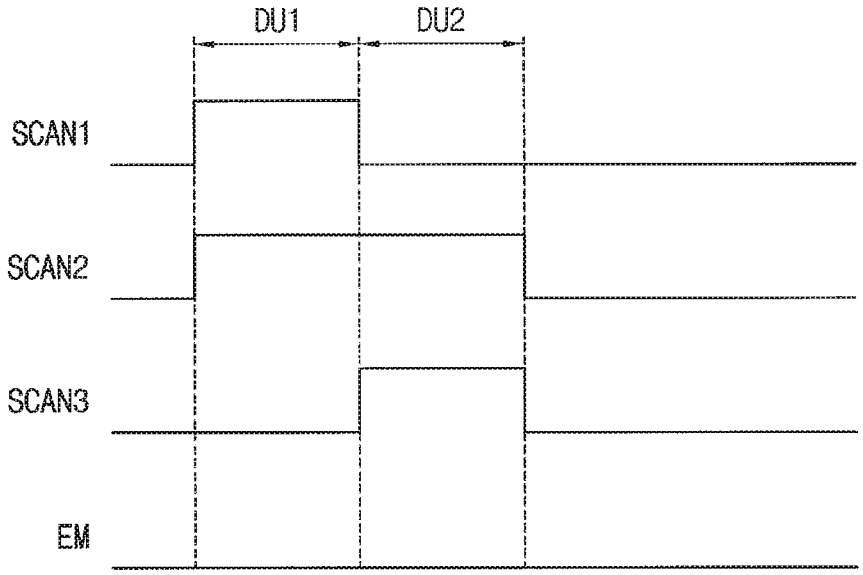
FIG. 3A is a timing diagram illustrating input signals applied to the pixel circuit of FIG. 2 in a threshold voltage sensing mode.
Figure 3B:
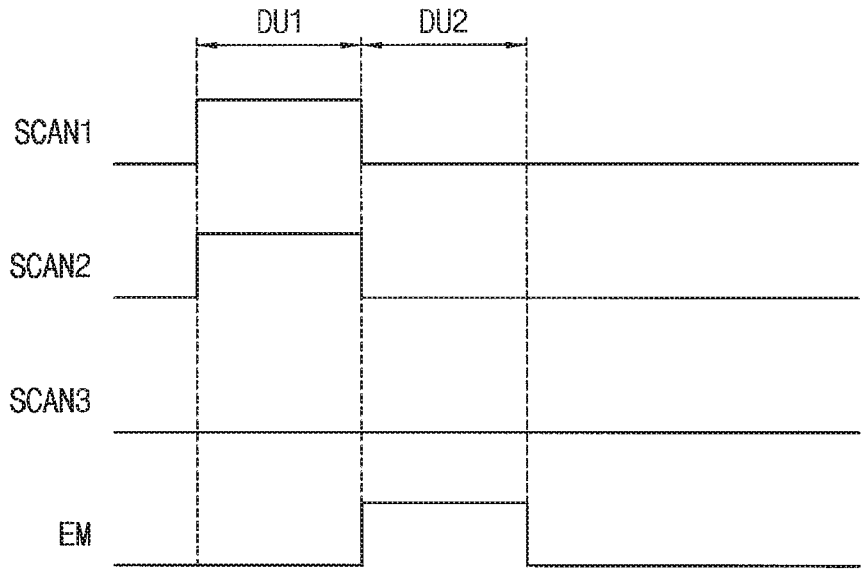
FIG. 3B is a timing diagram illustrating input signals applied to the pixel circuit of FIG. 2 in a display mode.

FIG. 3A is a timing diagram illustrating input signals applied to the pixel circuit of FIG. 2 in a threshold voltage sensing mode. FIG. 3B is a timing diagram illustrating input signals applied to the pixel circuit of FIG. 2 in a display mode.

Referring to FIGS. 1, 2, 3A, and 3B, a threshold voltage Vth of the first switching element TR1 may be sensed at an outside of the pixel circuit. Each sensed threshold voltage Vth of the first switching element of the pixel circuit may be stored in the driving controller 200. When the driving controller 200 generates the data signal DATA, the driving controller 200 may compensate the variance of the threshold voltages Vth of the first switching elements TR1 of the pixel circuits. The driving controller 200 may output the data signal DATA including compensation of the variance of the threshold voltages Vth to the data driver 500.

The pixel circuit may be operated in one of the threshold voltage sensing mode and the display mode. In the threshold voltage sensing mode, the threshold voltages Vth of the first switching elements TR1 of the pixel circuits of the display panel 100 are sensed. For example, a manufacturer of the display apparatus may determine the variance of the threshold voltages Vth of the first switching elements TR1 of the pixel circuits of the display panel 100 before selling the display apparatus to a user. The manufacturer may compensate the variance of the threshold voltages Vth of the first switching elements TR1 when selling the display apparatus to the user. In addition, the threshold voltages Vth of the first switching elements TR1 may be sensed to compensate a shift of the threshold voltage Vth generated by use of the display panel 100 after the display apparatus is sold to the user. In addition, the threshold voltage Vth of the first switching element TR1 may be sensed in real time during an operation of the display panel 100 and the data voltage VD compensating the variance of the threshold voltages Vth of the first switching elements TR1 may be generated in real time after the display apparatus is sold to the user.

FIG. 3A represents the operation of the pixel circuit in the threshold voltage sensing mode. During a first duration DU1 of the threshold voltage sensing mode, the first scan signal SCAN1, and the second scan signal SCAN2 may have an activation level and the third scan signal SCAN3 may have a deactivation level. During a second duration DU2 of the threshold voltage sensing mode, the first scan signal SCAN1 may have the deactivation level, and the second scan signal SCAN2 and the third scan signal SCAN3 may have the activation level.

In the present exemplary embodiment, the first to fifth switching elements TR1 to TR5 may be N-type transistors so that the activation level of the first to third scan signals SCAN1 to SCAN3 may be a high level and the deactivation level of the first to third scan signals SCAN1 to SCAN3 may be a low level.

During the first duration DU1 of the threshold voltage sensing mode, the first scan signal SCAN1 has the activation level so that the data voltage VD is applied to the control electrode of the first switching element TR1 through the data line DL and the second switching element TR2.

During the first duration DU1 of the threshold voltage sensing mode, the second scan signal SCAN2 has the activation level so that the initialization voltage VI is applied to the first electrode of the organic light emitting element OL through the third switching element TR3.

During the first duration DU1 of the threshold voltage sensing mode, the third scan signal SCAN3 has the deactivation level so that the fifth switching element TR5 is turned off.

During the first duration DU1 of the threshold voltage sensing mode, the emission signal EM has the deactivation level so that the fourth switching element TR4 is turned off.

During the second duration DU2 of the threshold voltage sensing mode, the threshold voltage Vth of the first switching element is sensed.

During the second duration DU2 of the threshold voltage sensing mode, the first scan signal SCAN1 has the deactivation level so that the second switching element TR2 is turned off.

During the second duration DU2 of the threshold voltage sensing mode, the first switching element TR1 is turned on by the data voltage VD which is charged at the capacitor CST during the first duration DU1 of the threshold voltage sensing mode.

During the second duration DU2 of the threshold voltage sensing mode, the second scan signal SCAN2, and the third scan signal SCAN3 have the activation level so that the fifth switching element TR5 and the third switching element TR3 are turned on. The fifth switching element TR5, the first switching element TR1, and the third switching element TR3 form a current path.

The current flowing through the first switching element TR1 is sensed through an initialization voltage applying line SL which outputs the initialization voltage VI. The threshold voltage Vth of the first switching element TR1 may be determined based on the current flowing through the first switching element TR1. An analog front end ("AFE") which is a current sensing circuit may be connected to an end portion of the initialization voltage applying line SL.

The third scan signal SCAN3 and the fifth switching element TR5 may be elements to sense the threshold voltage Vth of the first switching element TR1.

During the second duration DU2 of the threshold voltage sensing mode, the emission signal EM has the deactivation level so that the fourth switching element TR4 may be turned off.

In the present exemplary embodiment, a length of the second duration DU2 of the threshold voltage sensing mode may be substantially the same as a length of the first duration DU1 of the threshold voltage sensing mode. Alternatively, the length of the second duration DU2 of the threshold voltage sensing mode may be set different from the length of the first duration DU1 of the threshold voltage sensing mode.

FIG. 3B represents the operation of the pixel circuit in the display mode. During a first duration DU1 of the display mode, the first scan signal SCAN1 and the second scan signal SCAN2 may have the activation level and the third scan signal SCAN3 may have the deactivation level. During a second duration DU2 of the display mode, the first scan signal SCAN1, the second scan signal SCAN2, and the third scan signal SCAN3 may have the deactivation level and the emission signal EM may have the activation level.

In the display mode, the third scan signal SCAN3 may maintain the deactivation level so that the fifth switching element TR5 is not turned on.

During the first duration DU1 of the display mode, the first scan signal SCAN1 has the activation level so that the data voltage VD is applied to the control electrode of the first switching element TR1 through the data line DL and the second switching element TR2.

During the second duration DU2 of the display mode, the emission signal EM has the activation level so that the fourth switching element TR4 is turned on. In addition, during the second duration DU2 of the display mode, the first switching element TR1 is turned on by the data voltage VD which is charged at the capacitor CST during the first duration DU1 of the display mode.

During the second duration DU2 of the display mode, the fourth switching element TR4 and the first switching element TR1 are turned on so that the organic light emitting element OL emits light.

During the second duration DU2 of the display mode, the first to third scan signals SCAN1 to SCAN3 have the deactivation level so that the second switching element TR2, the third switching element TR3, and the fifth switching element TR5 are turned off.

According to the present exemplary embodiment, the threshold voltage Vth of the driving switching element TR1 in the pixel circuit may be sensed and the threshold voltage Vth of the driving switching element TR1 may be compensated. Thus, the luminance uniformity of the display panel 100 may be enhanced so that the display quality may be enhanced.

In addition, the elements compensating the threshold voltage Vth may not be included in the pixel circuit. The elements compensating the threshold voltage Vth may sense the threshold voltage Vth at a location outside of the pixel circuit so that the number of the switching elements in the pixel circuit may be reduced. Thus, the manufacturing cost of the display panel 100 may be reduced.

Figure 4:
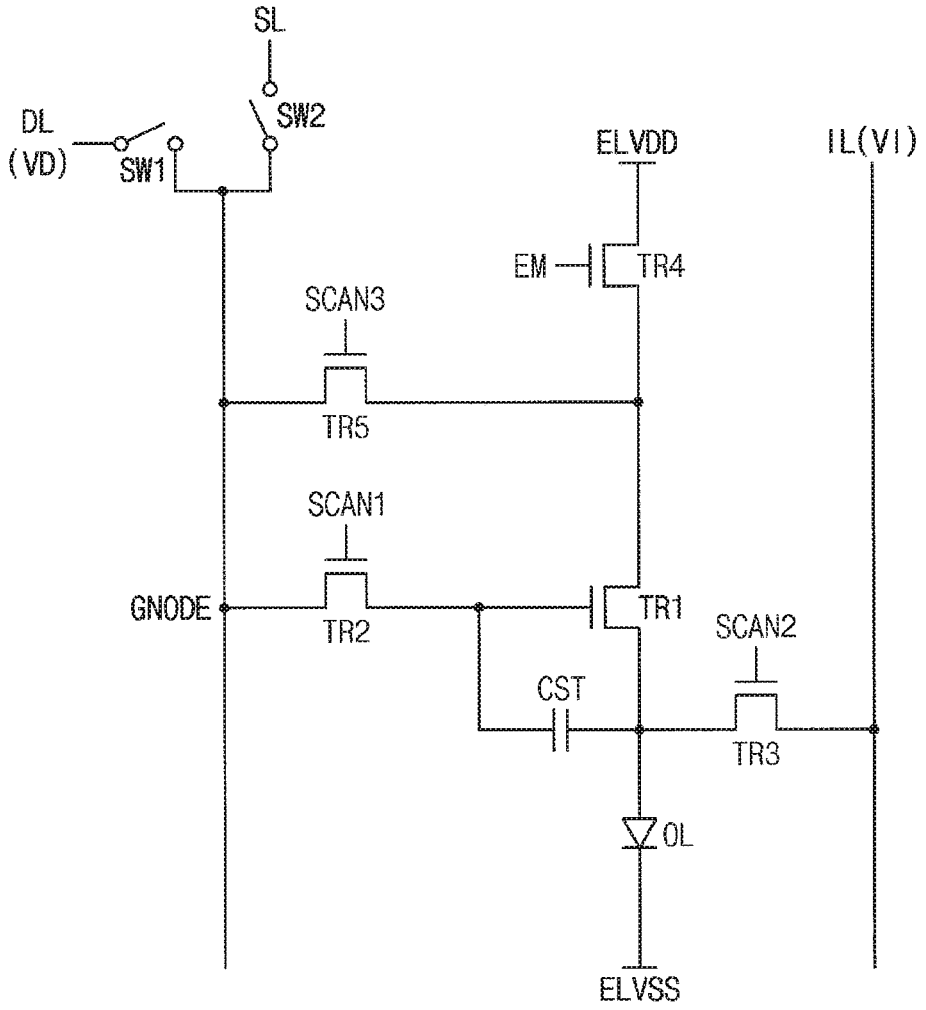
FIG. 4 is a circuit diagram illustrating a pixel circuit of a display panel of a display apparatus according to an exemplary embodiment of the inventive concepts.
Figure 5:
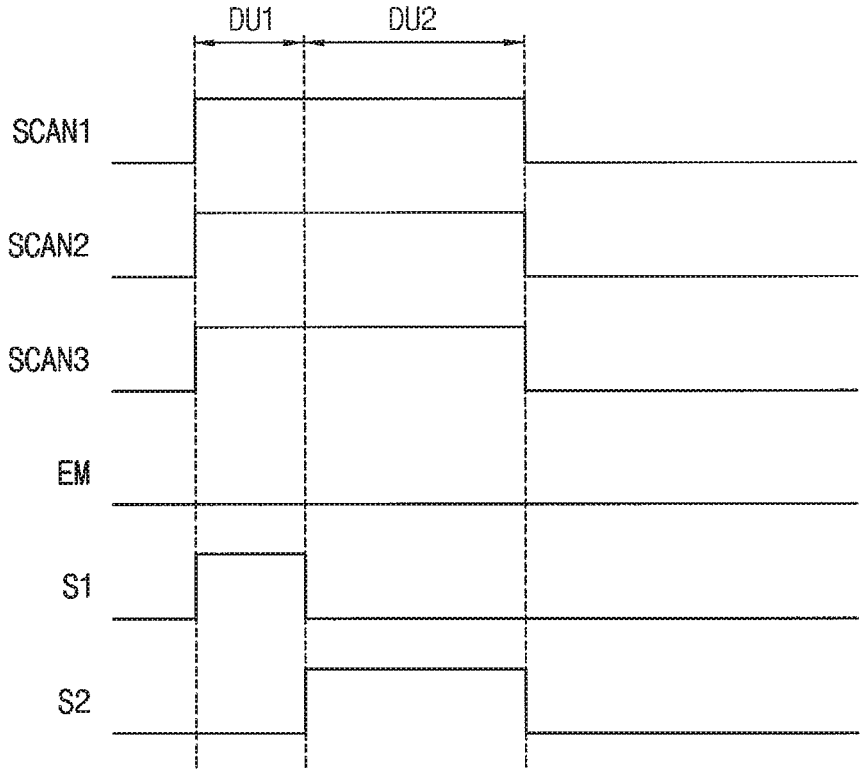
FIG. 5 is a timing diagram illustrating input signals applied to the pixel circuit of FIG. 4 in the threshold voltage sensing mode.
Figure 6:
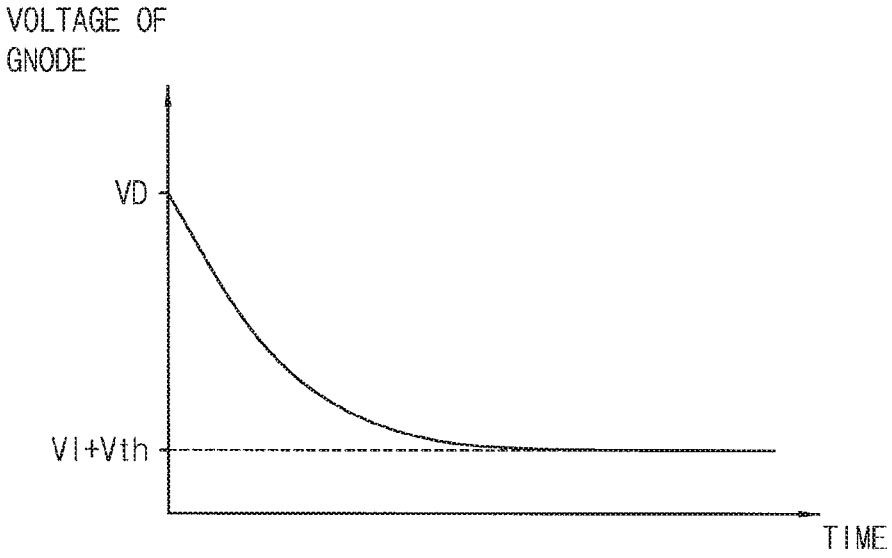
FIG. 6 is a graph illustrating a voltage sensed at GNODE of FIG. 4.

FIG. 4 is a circuit diagram illustrating a pixel circuit of a display panel 100 of a display apparatus according to an exemplary embodiment of the inventive concepts. FIG. 5 is a timing diagram illustrating input signals applied to the pixel circuit of FIG. 4 in the threshold voltage sensing mode. FIG. 6 is a graph illustrating a voltage sensed at GNODE of FIG. 4.

The display apparatus according to this exemplary embodiment is substantially the same as the display apparatus of the previous exemplary embodiment explained referring to FIGS. 1, 2, 3A, and 3B except for the structure of the pixel circuit of the display panel and the input signal applied to the pixel circuit. Thus, the same reference numerals will be used to refer to the same or like parts as those described in the previous exemplary embodiment of FIGS. 1, 2, 3A, and 3B and any repetitive explanation concerning the above elements will be omitted.

Referring to FIGS. 1, 4, 5, and 6, the display apparatus includes a display panel 100 and a display panel driver. The display panel driver includes a driving controller 200, a gate driver 300, a gamma reference voltage generator 400, a data driver 500 and an emission driver 600.

The display panel 100 includes a plurality of pixel circuits.

In the present exemplary embodiment, the pixel circuit includes a first switching element TR1, a second switching element TR2, a third switching element TR3, a fourth switching element TR4, a fifth switching element TR5, an organic light emitting element OL, and a capacitor CST.

The first switching element TR1 includes a control electrode, an input electrode, and an output electrode.

The second switching element TR2 includes a control electrode to which a first scan signal SCAN1 is applied, an input electrode to which a data voltage VD is applied, and an output electrode connected to the control electrode of the first switching element TR1.

The third switching element TR3 includes a control electrode to which a second scan signal SCAN2 is applied, an input electrode to which an initialization voltage VI is applied, and an output electrode connected to the output electrode of the first switching element TR1.

The fourth switching element TR4 includes a control electrode to which an emission signal EM is applied, an input electrode to which a first power voltage ELVDD is applied, and an output electrode connected to the input electrode of the first switching element TR1.

The fifth switching element TR5 includes a control electrode to which a third scan signal SCAN3 is applied, an input electrode to which the data voltage VD is applied, and an output electrode connected to the input electrode of the first switching element TR1.

The organic light emitting element OL includes a first electrode connected to the output electrode of the first switching element TR1 and a second electrode to which a second power voltage ELVSS is applied.

The capacitor CST includes a first end connected to the control electrode of the first switching element TR1 and a second end connected to the output electrode of the first switching element TR1.

In the present exemplary embodiment, the first to fifth switching elements TR1 to TR5 may be N-type transistors. For example, the first to fifth switching elements TR1 to TR5 may be oxide thin film transistors.

The pixel circuit may further include a first switch SW1 connecting the input electrode of the second switching element TR2 and the data line DL, and a second switch SW2 connecting the input electrode of the second switching element TR2 and a sensing line SL.

In the present exemplary embodiment, the initialization voltage VI may be applied through an initialization line IL. For example, the sensing line SL and the initialization line IL may be independently formed.

The pixel circuit may be operated in one of the threshold voltage sensing mode and the display mode.

During a first duration DU1 of the threshold voltage sensing mode, the first scan signal SCAN1, the second scan signal SCAN2, the third scan signal SCAN3, and a control signal S1 of the first switch SW1 may have an activation level and a control signal S2 of the second switch SW2 may have a deactivation level. During a second duration DU2 of the threshold voltage sensing mode, the first scan signal SCAN1, the second scan signal SCAN2, the third scan signal SCAN3, and the control signal S2 of the second switch SW2 may have the activation level and the control signal S1 of the first switch SW1 may have the deactivation level.

In the present exemplary embodiment, the first to fifth switching elements TR1 to TR5 may be N-type transistors so that the activation level of the first to third scan signals SCAN1 to SCAN3 may be a high level and the deactivation level of the first to third scan signals SCAN1 to SCAN3 may be a low level.

For example, the activation level of the control signal of the first switch SW1 and the control signal of the second switch SW2 may be the high level and the deactivation level of the control signal of the first switch SW1 and the control signal of the second switch SW2 may be the low level.

In the present exemplary embodiment, during the first duration DU1 and the second duration DU2 of the threshold voltage sensing mode, all of the first to third scan signals SCAN1 to SCAN3 may have the activation level. During the first duration DU1 of the threshold voltage sensing mode, the data line DL applies the data voltage VD to the input electrode of the second switching element TR2 through the first switch SW1. During the second duration DU2 of the threshold voltage sensing mode, the sensing line SL is connected to the input electrode of the second switching element TR2 to sense the threshold voltage Vth of the first switching element TR1 through the sensing line SL.

In the present exemplary embodiment, during the second duration DU2 of the threshold voltage sensing mode, the threshold voltage Vth of the first switching element TR1 may be sensed based on the voltage of the input electrode GNODE of the second switching element TR2 using the second switch SW2 and the sensing line SL.

When the second duration DU2 of the threshold voltage sensing mode starts, the voltage of the input electrode GNODE of the second switching element TR2 gradually decrease from a level of the data voltage VD and is converged to a level of a sum of the initialization voltage VI and the threshold voltage Vth of the first switching element TR1.

In the present exemplary embodiment, the length of the second duration DU2 of the threshold voltage sensing mode may be longer than the length of the first duration DU1 of the threshold voltage sensing mode. A sufficient time for the voltage of the input electrode GNODE of the second switching element TR2 to be converged to the level of the sum of the initialization voltage VI and the threshold voltage Vth of the first switching element TR1 is needed in the second duration DU2 of the threshold voltage sensing mode so that the second duration DU2 of the threshold voltage sensing mode may be set longer than the first duration DU1 of the threshold voltage sensing mode.

The third scan signal SCAN3, the fifth switching element TR5 and the second switch SW2 may be elements to sense the threshold voltage Vth of the first switching element TR1.

In the display mode, the third scan signal SCAN3 and the control signal S2 of the second switch SW2 may maintain the deactivation level.

During a first duration of the display mode, the first scan signal SCAN1, the second scan signal SCAN2, and the control signal S1 of the first switch SW1 may have the activation level and the third scan signal SCAN3, the control signal S2 of the second switch SW2, and the emission signal EM may have the deactivation level.

During a second duration of the display mode, the first scan signal SCAN1, the second scan signal SCAN2, the third scan signal SCAN3, and the control signal S2 of the second switch SW2 may have the deactivation level and the emission signal EM may have the activation level.

According to the present exemplary embodiment, the threshold voltage Vth of the driving switching element TR1 in the pixel circuit may be sensed and the threshold voltage Vth of the driving switching element TR1 may be compensated. Thus, the luminance uniformity of the display panel 100 may be enhanced so that the display quality may be enhanced.

In addition, the elements compensating the threshold voltage Vth may not be included in the pixel circuit. The elements compensating the threshold voltage Vth may sense the threshold voltage Vth at an outside of the pixel circuit so that the number of the switching elements in the pixel circuit may be reduced. Thus, the manufacturing cost of the display panel 100 may be reduced.

Figure 7:
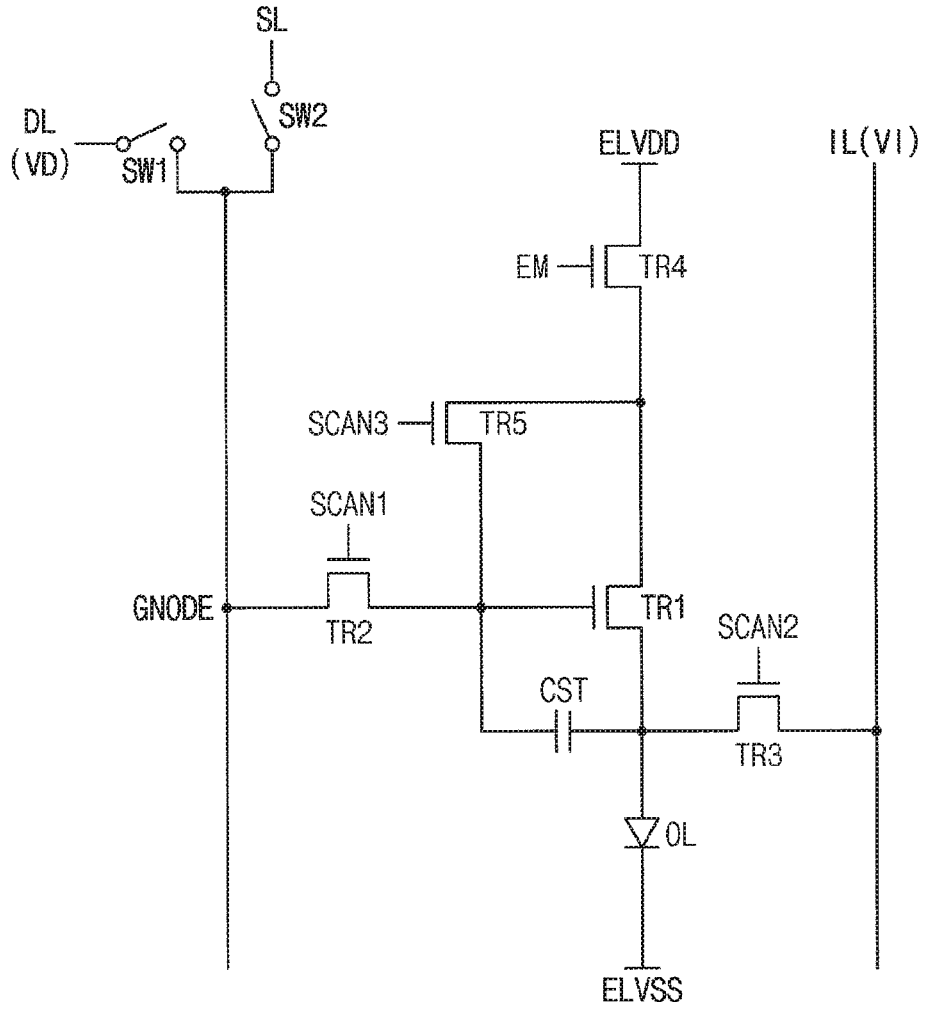
FIG. 7 is a circuit diagram illustrating a pixel circuit of a display panel of a display apparatus according to an exemplary embodiment of the inventive concepts.
Figure 8:
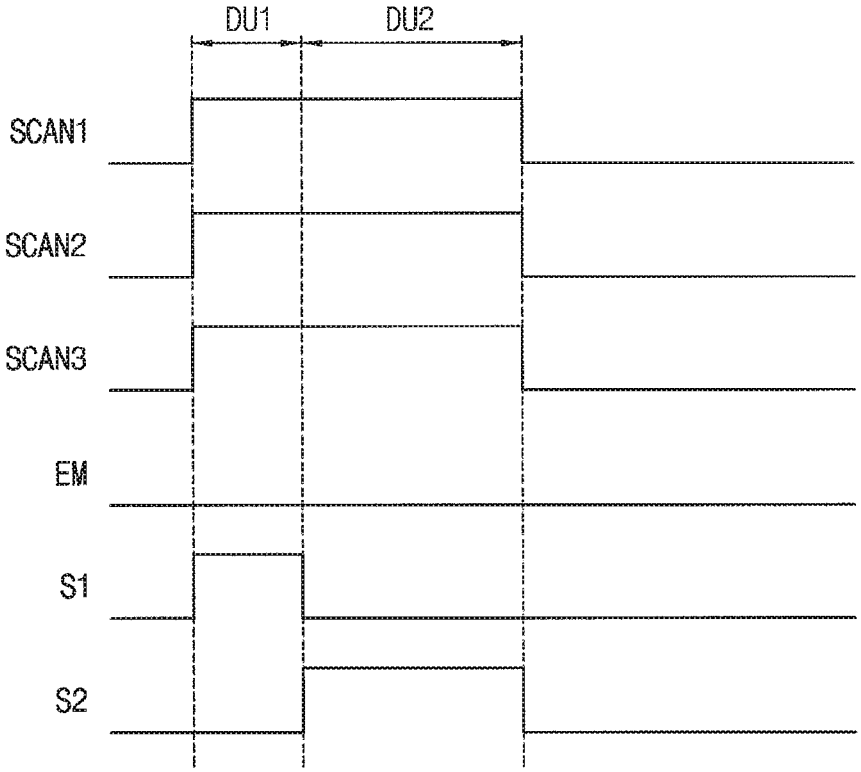
FIG. 8 is a timing diagram illustrating input signals applied to the pixel circuit of FIG. 7 in the threshold voltage sensing mode.

FIG. 7 is a circuit diagram illustrating a pixel circuit of a display panel 100 of a display apparatus according to an exemplary embodiment of the inventive concepts. FIG. 8 is a timing diagram illustrating input signals applied to the pixel circuit of FIG. 7 in the threshold voltage sensing mode.

The display apparatus according to the present exemplary embodiment is substantially the same as the display apparatus of the previous exemplary embodiment explained referring to FIGS. 4, 5, and 6 except for the connection of the fifth switching element and the other elements. Thus, the same reference numerals will be used to refer to the same or like parts as those described in the previous exemplary embodiment of FIGS. 4, 5, and 6 and any repetitive explanation concerning the above elements will be omitted.

Referring to FIGS. 1, 6, 7, and 8, the display apparatus includes a display panel 100 and a display panel driver. The display panel driver includes a driving controller 200, a gate driver 300, a gamma reference voltage generator 400, a data driver 500, and an emission driver 600.

The display panel 100 includes a plurality of pixel circuits.

In the present exemplary embodiment, the pixel circuit includes a first switching element TR1, a second switching element TR2, a third switching element TR3, a fourth switching element TR4, a fifth switching element TR5, an organic light emitting element OL, and a capacitor CST.

The first switching element TR1 includes a control electrode, an input electrode, and an output electrode.

The second switching element TR2 includes a control electrode to which a first scan signal SCAN1 is applied, an input electrode to which a data voltage VD is applied, and an output electrode connected to the control electrode of the first switching element TR1.

The third switching element TR3 includes a control electrode to which a second scan signal SCAN2 is applied, an input electrode to which an initialization voltage VI is applied, and an output electrode connected to the output electrode of the first switching element TR1.

The fourth switching element TR4 includes a control electrode to which an emission signal EM is applied, an input electrode to which a first power voltage ELVDD is applied, and an output electrode connected to the input electrode of the first switching element TR1.

The fifth switching element TR5 includes a control electrode to which a third scan signal SCAN3 is applied, an input electrode connected to the input electrode of the first switching element TR1, and an output electrode connected to the control electrode of the first switching element TR1.

The organic light emitting element OL includes a first electrode connected to the output electrode of the first switching element TR1 and a second electrode to which a second power voltage ELVSS is applied.

The capacitor CST includes a first end connected to the control electrode of the first switching element TR1 and a second end connected to the output electrode of the first switching element TR1.

In the present exemplary embodiment, the first to fifth switching elements TR1 to TR5 may be N-type transistors. For example, the first to fifth switching elements TR1 to TR5 may be oxide thin film transistor.

The pixel circuit may further include a first switch SW1 connecting the input electrode of the second switching element TR2 and the data line DL and a second switch SW2 connecting the input electrode of the second switching element TR2 and a sensing line SL.

In the present exemplary embodiment, the initialization voltage VI may be applied through an initialization line IL. For example, the sensing line SL and the initialization line IL may be independently formed.

The pixel circuit may be operated in one of the threshold voltage sensing mode and the display mode.

During a first duration DU1 of the threshold voltage sensing mode, the first scan signal SCAN1, the second scan signal SCAN2, the third scan signal SCAN3, and a control signal S1 of the first switch SW1 may have an activation level and a control signal S2 of the second switch SW2 may have a deactivation level. During a second duration DU2 of the threshold voltage sensing mode, the first scan signal SCAN1, the second scan signal SCAN2, the third scan signal SCAN3, and the control signal S2 of the second switch SW2 may have the activation level and the control signal S1 of the first switch SW1 may have the deactivation level.

In the present exemplary embodiment, during the first duration DU1 and the second duration DU2 of the threshold voltage sensing mode, all of the first to third scan signals SCAN1 to SCAN3 may have the activation level. During the first duration DU1 of the threshold voltage sensing mode, the data line DL applies the data voltage VD to the input electrode of the second switching element TR2 through the first switch SW1. During the second duration DU2 of the threshold voltage sensing mode, the sensing line SL is connected to the input electrode of the second switching element TR2 to sense the threshold voltage Vth of the first switching element TR1 through the sensing line SL.

In the present exemplary embodiment, during the second duration DU2 of the threshold voltage sensing mode, the threshold voltage Vth of the first switching element TR1 may be sensed based on the voltage of the input electrode GNODE of the second switching element TR2 using the second switch SW2 and the sensing line SL.

In the present exemplary embodiment, the length of the second duration DU2 of the threshold voltage sensing mode may be longer than the length of the first duration DU1 of the threshold voltage sensing mode.

The third scan signal SCAN3, the fifth switching element TR5 and the second switch SW2 may be elements to sense the threshold voltage Vth of the first switching element TR1.

In the display mode, the third scan signal SCAN3 and the control signal S2 of the second switch SW2 may maintain the deactivation level.

During a first duration of the display mode, the first scan signal SCAN1, the second scan signal SCAN2, and the control signal S1 of the first switch SW1 may have the activation level and the third scan signal SCAN3, the control signal S2 of the second switch SW2, and the emission signal EM may have the deactivation level.

During a second duration of the display mode, the first scan signal SCAN1, the second scan signal SCAN2, the third scan signal SCAN3, and the control signal S2 of the second switch SW2 may have the deactivation level and the emission signal EM may have the activation level.

According to the present exemplary embodiment, the threshold voltage Vth of the driving switching element TR1 in the pixel circuit may be sensed and the threshold voltage Vth of the driving switching element TR1 may be compensated. Thus, the luminance uniformity of the display panel 100 may be enhanced so that the display quality may be enhanced.

In addition, the elements compensating the threshold voltage Vth may not be included in the pixel circuit. The elements compensating the threshold voltage Vth may sense the threshold voltage Vth at an outside of the pixel circuit so that the number of the switching elements in the pixel circuit may be reduced. Thus, the manufacturing cost of the display panel 100 may be reduced.

Figure 9:
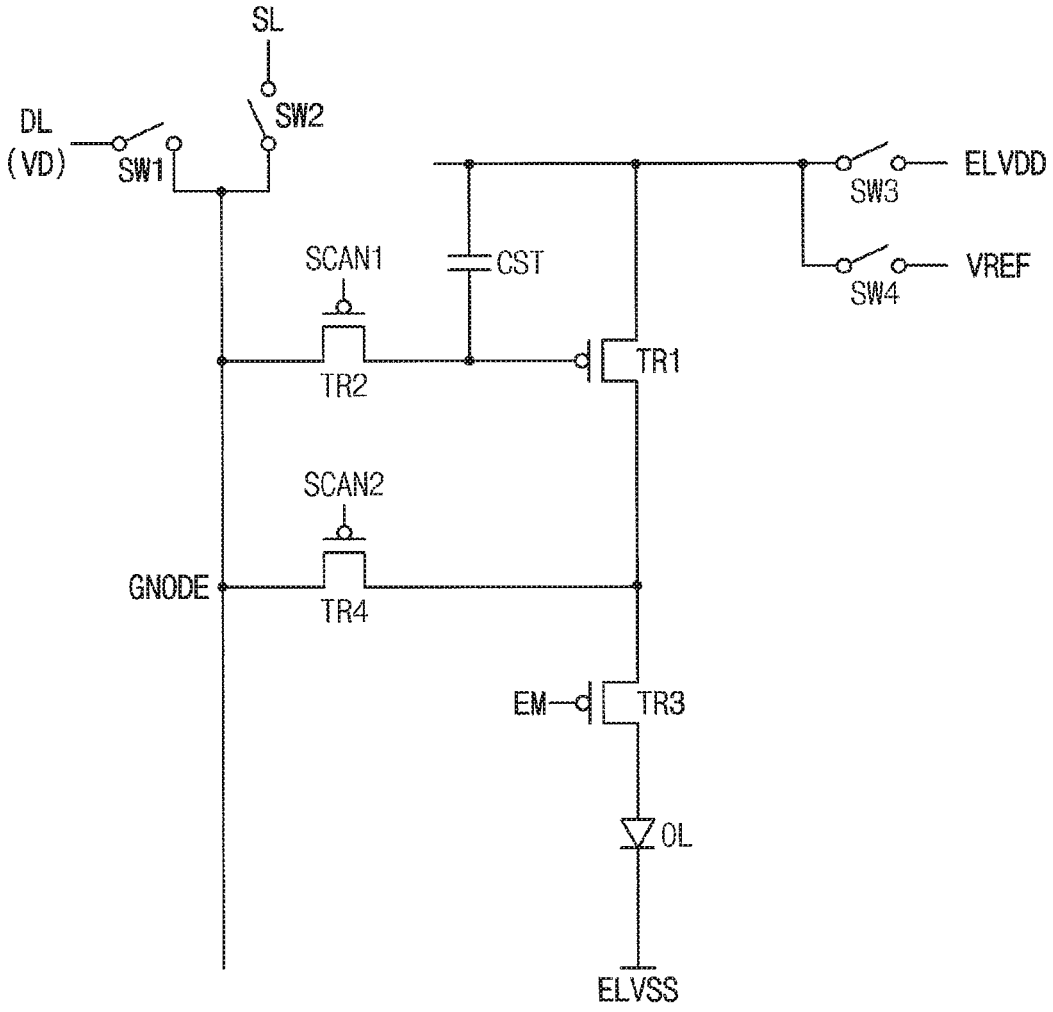
FIG. 9 is a circuit diagram illustrating a pixel circuit of a display panel of a display apparatus according to an exemplary embodiment of the inventive concepts.
Figure 10:
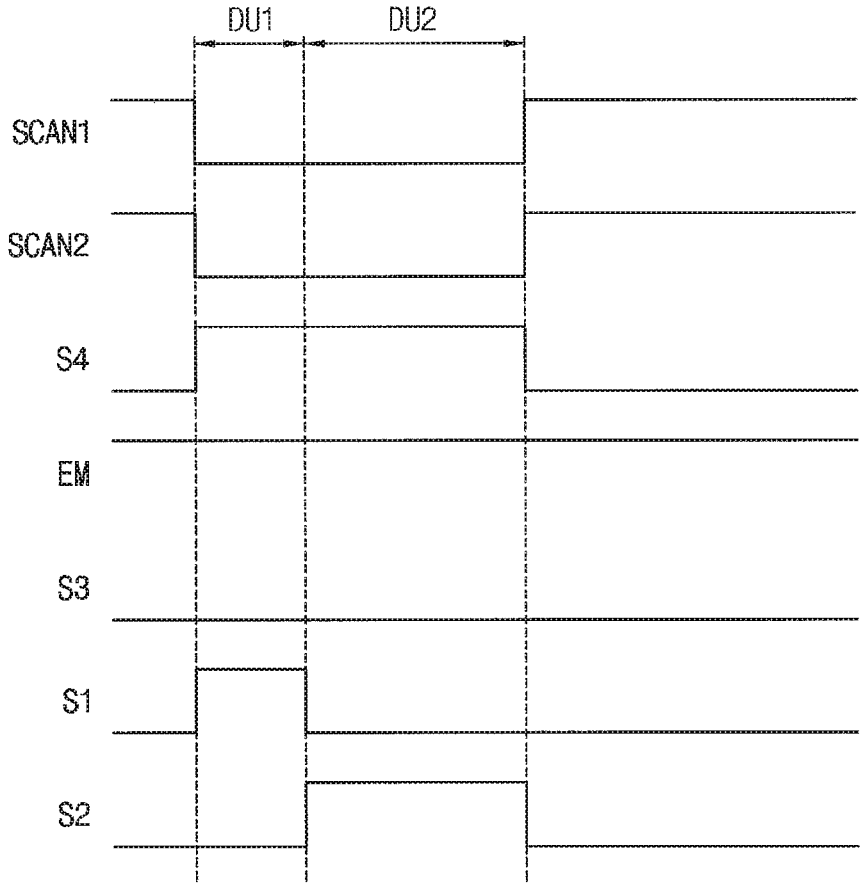
FIG. 10 is a timing diagram illustrating input signals applied to the pixel circuit of FIG. 9 in the threshold voltage sensing mode.

FIG. 9 is a circuit diagram illustrating a pixel circuit of a display panel 100 of a display apparatus according to an exemplary embodiment of the inventive concepts. FIG. 10 is a timing diagram illustrating input signals applied to the pixel circuit of FIG. 9 in the threshold voltage sensing mode.

The display apparatus according to the present exemplary embodiment is substantially the same as the display apparatus of the previous exemplary embodiment explained referring to FIGS. 1, 2, 3A, and 3B except for the structure of the pixel circuit of the display panel and the input signal applied to the pixel circuit. Thus, the same reference numerals will be used to refer to the same or like parts as those described in the previous exemplary embodiment of FIGS. 1, 2, 3A, and 3B and any repetitive explanation concerning the above elements will be omitted.

Referring to FIGS. 1, 9 and 10, the display apparatus includes a display panel 100 and a display panel driver. The display panel driver includes a driving controller 200, a gate driver 300, a gamma reference voltage generator 400, a data driver 500, and an emission driver 600.

The display panel 100 includes a plurality of pixel circuits.

In the present exemplary embodiment, the pixel circuit includes a first switching element TR1, a second switching element TR2, a third switching element TR3, a fourth switching element TR4, an organic light emitting element OL, and a capacitor CST.

The first switching element TR1 includes a control electrode, an input electrode, and an output electrode.

The second switching element TR2 includes a control electrode to which a first scan signal SCAN1 is applied, an input electrode to which a data voltage VD is applied, and an output electrode connected to the control electrode of the first switching element TR1.

The third switching element TR3 includes a control electrode to which an emission signal EM is applied, an input electrode connected to the output electrode of the first switching element TR1, and an output electrode connected to a first electrode of an organic light emitting element OL.

The fourth switching element TR4 includes a control electrode to which a second scan signal SCAN2 is applied, an input electrode to which the data voltage VD is applied, and an output electrode connected to the output electrode of the first switching element TR1.

The organic light emitting element OL includes the first electrode connected to the output electrode of the third switching element TR3 and a second electrode to which a low power voltage ELVSS is applied.

The capacitor CST includes a first end connected to the input electrode of the first switching element TR1 and a second end connected to the control electrode of the first switching element TR1.

In the present exemplary embodiment, the first to fourth switching elements TR1 to TR4 may be P-type transistors. For example, the first to fourth switching elements TR1 to TR5 may be polysilicon thin film transistors. For example, the first to fourth switching elements TR1 to TR5 may be low temperature polysilicon ("LTPS") thin film transistors.

The pixel circuit may further include a first switch SW1 connecting the input electrode of the second switching element TR2 and the data line DL and a second switch SW2 connecting the input electrode of the second switching element TR2 and a sensing line SL.

The pixel circuit may further include a third switch SW3 applying a high power voltage ELVDD to the input electrode of the first switching element TR1 and a fourth switch SW4 applying a reference voltage VREF to the input electrode of the first switching element TR1.

The high power voltage ELVDD is a power voltage to turn on the organic light emitting element OL. The reference voltage VREF is applied to the input electrode of the first switching element TR1 when the pixel circuit is operated in the threshold voltage sensing mode. The reference voltage VREF may be less than the high power voltage ELVDD.

The pixel circuit may be operated in one of the threshold voltage sensing mode and the display mode.

During a first duration DU1 of the threshold voltage sensing mode, the first scan signal SCAN1, the second scan signal SCAN2, a control signal S1 of the first switch SW1, and a control signal S4 of the fourth switch SW4 may have an activation level and a control signal S2 of the second switch SW2, and a control signal S3 of the third switch SW3 may have a deactivation level.

During a second duration DU2 of the threshold voltage sensing mode, the first scan signal SCAN1, the second scan signal SCAN2, the control signal S2 of the second switch SW2, and the control signal S4 of the fourth switch SW4 may have the activation level and the control signal S1 of the first switch SW1 and the control signal S3 of the third switch SW3 may have the deactivation level.

In the present exemplary embodiment, the first to fourth switching elements TR1 to TR4 may be P-type transistors so that the activation level of the first and second scan signals SCAN1 and SCAN2 may be a low level and the deactivation level of the first and second scan signals SCAN1 and SCAN2 may be a high level.

For example, the activation level of the control signal of the first to fourth switches SW1 to SW4 may be the high level and the deactivation level of the control signal of the first to fourth switches SW1 to SW4 may be the low level.

In the present exemplary embodiment, during the first duration DU1 and the second duration DU2 of the threshold voltage sensing mode, both of the first and second scan signals SCAN1 and SCAN2 may have the activation level. During the first duration DU1 of the threshold voltage sensing mode, the data line DL applies the data voltage VD to the input electrode of the second switching element TR2 through the first switch SW1. During the second duration DU2 of the threshold voltage sensing mode, the sensing line SL is connected to the input electrode of the second switching element TR2 to sense the threshold voltage Vth of the first switching element TR1 through the sensing line SL.

In the present exemplary embodiment, during the second duration DU2 of the threshold voltage sensing mode, the threshold voltage Vth of the first switching element TR1 may be sensed based on the voltage of the input electrode GNODE of the second switching element TR2 using the second switch SW2 and the sensing line SL.

In the present exemplary embodiment, the length of the second duration DU2 of the threshold voltage sensing mode may be longer than the length of the first duration DU1 of the threshold voltage sensing mode.

The second scan signal SCAN2, the fourth switching element TR4, the second switch SW2, and the fourth switch SW4 may be elements to sense the threshold voltage Vth of the first switching element TR1.

In the display mode, the second scan signal SCAN2, the control signal S2 of the second switch SW2, and the control signal S4 of the fourth switch SW4 may maintain the deactivation level.

According to the exemplary embodiment, the threshold voltage Vth of the driving switching element TR1 in the pixel circuit may be sensed and the threshold voltage Vth of the driving switching element TR1 may be compensated.

Thus, the luminance uniformity of the display panel 100 may be enhanced so that the display quality may be enhanced.

In addition, the elements compensating the threshold voltage Vth may not be included in the pixel circuit. The elements compensating the threshold voltage Vth may sense the threshold voltage Vth at an outside of the pixel circuit so that the number of the switching elements in the pixel circuit may be reduced. Thus, the manufacturing cost of the display panel 100 may be reduced.

According to the inventive concepts as explained above, the display quality of the display panel may be enhanced and the manufacturing cost of the display panel may be reduced.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A pixel circuit of a display apparatus comprising:

a first switching element comprising a control electrode, an input electrode, and an output electrode;

a second switching element comprising a control electrode connected to a first gate line to receive a first scan signal, an input electrode connected to a data line to receive a data voltage, and an output electrode connected to the control electrode of the first switching element;

a third switching element comprising a control electrode connected to a second gate line to receive a second scan signal, an input electrode connected to an initialization voltage applying line to receive an initialization voltage, and an output electrode connected to the output electrode of the first switching element;

a fourth switching element comprising a control electrode connected to an emission line to receive an emission signal, an input electrode connected to a first power voltage applying line to receive a first power voltage, and an output electrode connected to the input electrode of the first switching element;

a fifth switching element comprising a control electrode connected to a third gate line to receive a third scan signal, an input electrode connected to a second gate line the data line to receive the data voltage, and an output electrode connected to the input electrode of the first switching element;

an organic light emitting element comprising a first electrode connected to the output electrode of the first switching element and a second electrode connected to a second power voltage applying line to receive a second power voltage; and a capacitor comprising a first end connected to the control electrode of the first switching element and a second end connected to the output electrode of the first switching element.

2. A method of operating the pixel circuit of the display apparatus of claim 1, comprising:

configuring the first scan signal and the second scan signal to have an activation level and the third scan signal is configured to have a deactivation level during a first duration of a threshold voltage sensing mode, and configuring the first scan signal to have the deactivation level and the second scan signal and the third scan signal are configured to have the activation level during a second duration of the threshold voltage sensing mode.

3. The method of claim 2, further comprising:

configuring a threshold voltage of the first switching element to be sensed using the third switching element and configuring the initialization voltage applying line to apply the initialization voltage during the second duration of the threshold voltage sensing mode.

4. The method of claim 2, further comprising:

configuring the first scan signal and the second scan signal to have the activation level and configuring the third scan signal to have the deactivation level during a first duration of a display mode, and configuring the first scan signal, the second scan signal, and the third scan signal to have the deactivation level and configuring the emission signal to have the activation level during a second duration of the display mode.

5. The pixel circuit of the display apparatus of claim 1, further comprising:

a first switch connecting the input electrode of the second switching element and a data line; and a second switch connecting the input electrode of the second switching element and a sensing line.

6. A method of operating the pixel circuit of the display apparatus of claim 5, comprising:

configuring the first scan signal, the second scan signal, the third scan signal, and a control signal of the first switch to have an activation level and configuring a control signal of the second switch to have a deactivation level during a first duration of a threshold voltage sensing mode, and configuring the first scan signal, the second scan signal, the third scan signal, and the control signal of the second switch to have the activation level and configuring the control signal of the first switch to have the deactivation level during a second duration of the threshold voltage sensing mode.

7. The method of claim 6, further comprising:

configuring a length of the second duration of the threshold voltage sensing mode to be longer than a length of the first duration of the threshold voltage sensing mode.

8. The method of claim 6, further comprising:

configuring a threshold voltage of the first switching element to be sensed based on a voltage of the input electrode of the second switching element using the second switch and the sensing line during the second duration of the threshold voltage sensing mode.

9. The method of claim 6, further comprising:

configuring the first scan signal, the second scan signal, and the control signal of the first switch to have the activation level and the third scan signal and configuring the control signal of the second switch to have the deactivation level during a first duration of a display mode, and configuring the first scan signal, the second scan signal, the third scan signal, and the control signal of the second switch to have the deactivation level and configuring the emission signal to have the activation level during a second duration of the display mode.

10. The pixel circuit of the display apparatus of claim 1, wherein the first to fifth switching elements are N-type transistors.

11. A pixel circuit of a display apparatus comprising:

a first switching element comprising a control electrode, an input electrode, and an output electrode;

a second switching element comprising a control electrode connected to a first gate line to receive a first scan signal, an input electrode connected to a data line to receive a data voltage, and an output electrode connected to the control electrode of the first switching element;

a third switching element comprising a control electrode connected to a second gate line to receive a second scan signal, an input electrode connected to an initialization voltage applying line to receive an initialization voltage, and an output electrode connected to the output electrode of the first switching element;

a fourth switching element comprising a control electrode connected to an emission line to receive an emission signal, an input electrode connected to a first power voltage applying line to receive a first power voltage, and an output electrode connected to the input electrode of the first switching element;

a fifth switching element comprising a control electrode connected to a third gate line to receive a third scan signal, an input electrode connected to the input electrode of the first switching element, and an output electrode connected to the control electrode of the first switching element;

an organic light emitting element comprising a first electrode connected to the output electrode of the first switching element and a second electrode connected to a second power voltage applying line to receive a second power voltage; and a capacitor comprising a first end connected to the control electrode of the first switching element and a second end connected to the output electrode of the first switching element.

12. The pixel circuit of the display apparatus of claim 11, further comprising:

a first switch connecting the input electrode of the second switching element and a data line; and a second switch connecting the input electrode of the second switching element and a sensing line.

13. A method of operating the pixel circuit of the display apparatus of claim 12, comprising:

configuring the first scan signal, the second scan signal, the third scan signal, and a control signal of the first switch to have an activation level and configuring a control signal of the second switch to have a deactivation level during a first duration of a threshold voltage sensing mode, and configuring the first scan signal, the second scan signal, the third scan signal, and the control signal of the second switch to have the activation level, and configuring the control signal of the first switch to have the deactivation level during a second duration of the threshold voltage sensing mode.

14. The method of claim 13, further comprising:

configuring a length of the second duration of the threshold voltage sensing mode to be longer than a length of the first duration of the threshold voltage sensing mode.

15. The method of claim 13, further comprising:

configuring the first scan signal, the second scan signal, and the control signal of the first switch to have the activation level, and configuring the third scan signal, the control signal of the second switch, and the emission signal to have the deactivation level during a first duration of a display mode, and configuring the first scan signal, the second scan signal, the third scan signal, and the control signal of the second switch to have the deactivation level, and configuring the emission signal to have the activation level during a second duration of the display mode.

16. A pixel circuit of a display apparatus comprising:

a first switching element comprising a control electrode, an input electrode, and an output electrode;

a second switching element comprising a control electrode connected to a first gate line to receive a first scan signal, an input electrode connected to a data line to receive a data voltage, and an output electrode connected to the control electrode of the first switching element;

a third switching element comprising a control electrode connected to an emission line to receive an emission signal, an input electrode connected to the output electrode of the first switching element, and an output electrode connected to a first electrode of an organic light emitting element;

a fourth switching element comprising a control electrode connected to a second gate line to receive a second scan signal, an input electrode connected to the data line to receive the data voltage, and an output electrode connected to the output electrode of the first switching element;

the organic light emitting element comprising the first electrode connected to the output electrode of the third switching element and a second electrode which is connected to a low power voltage applying line to receive a low power voltage;

a capacitor comprising a first end connected to the input electrode of the first switching element and a second end connected to the control electrode of the first switching element;

a first switch configured to connect the input electrode of the second switching element and a data line;

a second switch configured to connect the input electrode of the second switching element and a sensing line;

a third switch configured to apply a high power voltage to the input electrode of the first switching element; and a fourth switch configured to apply a reference voltage to the input electrode of the first switching element.

17. A method of operating the pixel circuit of the display apparatus of claim 16, comprising:

configuring the first scan signal, the second scan signal, a control signal of the first switch, and a control signal of the fourth switch to have an activation level, and configuring a control signal of the second switch and a control signal of the third switch to have a deactivation level during a first duration of a threshold voltage sensing mode, and configuring the first scan signal, the second scan signal, the control signal of the second switch, and the control signal of the fourth switch to have the activation level, and configuring the control signal of the first switch and the control signal of the third switch to have the deactivation level during a second duration of the threshold voltage sensing mode.

18. The pixel circuit of the display apparatus of claim 16, wherein the first to fourth switching elements are P-type transistors.

* * * * *